US011993477B2

(12) United States Patent
Burke et al.

(10) Patent No.: US 11,993,477 B2
(45) Date of Patent: May 28, 2024

(54) RETRACTABLE TOOL LANYARD

(71) Applicant: CHECKMATE LIFTING & SAFETY LTD, Kent (GB)

(72) Inventors: Craig A. Burke, Sydney (AU); Oliver Auston, Faversham (GB); Christopher Stockbridge, Sittingbourne (GB)

(73) Assignee: CHECKMATE LIFTING & SAFETY LTD, Kent (GB)

( * ) Notice: Subject to any disclaimer, the term of this patent is extended or adjusted under 35 U.S.C. 154(b) by 435 days.

(21) Appl. No.: 17/404,267

(22) Filed: Aug. 17, 2021

(65) Prior Publication Data

US 2022/0055858 A1 Feb. 24, 2022

Related U.S. Application Data

(60) Provisional application No. 63/067,127, filed on Aug. 18, 2020.

(51) Int. Cl.

| | |
|---|---|
| ***B65H 75/44*** | (2006.01) |
| ***A45F 5/00*** | (2006.01) |
| ***B65H 75/42*** | (2006.01) |

(52) U.S. Cl.

CPC ..... *B65H 75/4444* (2013.01); *A45F 5/004* (2013.01); *B65H 75/42* (2013.01); *A45F 2005/006* (2013.01); *A45F 2200/0575* (2013.01)

(58) Field of Classification Search

CPC ..... B65H 75/00; B65H 75/4428; B65H 75/4444; B65H 75/4471; B65H 75/48; B65H 75/4418; B65H 75/4436; B65H 75/4442; B65H 75/406; B65H 75/4481; B65H 75/483; B65H 75/486; B65H 2402/54; B65H 2403/47; B65H 2403/733; B65H 2403/433; A45F 5/00; A45F 5/004; A45F 2005/006; A45F 2200/0575; A62B 35/00; A62B 35/0093; A43C 11/00; A43C 11/16; A43C 11/165

See application file for complete search history.

(56) References Cited

U.S. PATENT DOCUMENTS 721,460 A * 2/1903 MoDougall ..... A45F 5/004 242/379

2,990,131 A * 6/1961 Carlsson ..... A62B 35/0093 242/383.2

(Continued)

*Primary Examiner* — Michael R Mansen
*Assistant Examiner* — Raveen J Dias
(74) *Attorney, Agent, or Firm* — Dicke, Billig & Czaja, PLLC

(57) ABSTRACT

A retractable tool lanyard comprises a housing, a drum rotatably connected to the housing, a biasing member interconnecting the housing and the drum, a cord operatively connected to the drum and adapted to be wound about and paid out from the drum, and an engaging mechanism. The engaging mechanism comprises a locking plate connected to the drum, at least one lock pawl connected to the locking plate, and a ratchet plate. When the drum rotates at a predetermined speed, the at least one lock pawl pivots from an unlocked position to a locked position to engage the ratchet plate thereby rotating the ratchet plate with the drum. At least one of a braking mechanism and a clicker pawl are used to create friction to assist in reducing a rate of rotation of the drum.

20 Claims, 12 Drawing Sheets

(56) References Cited

U.S. PATENT DOCUMENTS 3,760,910 A * 9/1973 Koshihara ..... F16D 59/00 182/237
4,437,624 A * 3/1984 Rosenberg ..... B65H 75/486 242/381
4,511,123 A * 4/1985 Ostrobrod ..... A62B 1/10 254/378
4,523,664 A * 6/1985 Soubry ..... A62B 1/12 254/377
4,673,143 A * 6/1987 Intengan ..... A01K 89/0179 242/396.5
4,877,110 A * 10/1989 Wolner ..... A62B 35/0093 D29/124
4,913,371 A * 4/1990 Margetts ..... B65H 75/486 242/383.5
5,101,082 A * 3/1992 Simmons ..... B65H 75/4471 200/61.15
5,186,289 A * 2/1993 Wolner ..... F16D 59/00 188/65.1
5,447,280 A * 9/1995 Feathers ..... A62B 35/0093 242/396.6
5,829,548 A * 11/1998 Ostrobrod ..... E06C 7/18 182/241
6,189,666 B1 * 2/2001 Willmot ..... F16D 41/00 192/46
6,279,682 B1 8/2001 Feathers
6,283,398 B1 * 9/2001 Specht ..... B60R 22/405 242/384.6
6,523,771 B2 * 2/2003 Sumiyashiki ..... B60R 22/415 242/384.6
7,281,620 B2 * 10/2007 Wolner ..... F16D 63/006 192/223.1
8,052,080 B2 * 11/2011 Liang ..... B66D 5/16 242/379
8,181,744 B2 5/2012 Parker et al.
8,490,750 B2 7/2013 Balquist et al.
8,567,562 B2 * 10/2013 Meillet ..... A62B 1/10 182/232
8,800,715 B2 * 8/2014 Olson ..... A62B 1/10 182/237
8,950,551 B2 * 2/2015 Jones ..... F16F 7/123 182/236
8,991,556 B2 * 3/2015 Auston ..... B65H 75/28 182/234
9,121,462 B2 9/2015 Casebolt
9,460,831 B2 * 10/2016 Ledwith ..... B65H 75/4428
9,670,980 B2 * 6/2017 Jones ..... E04G 21/329
10,004,927 B2 * 6/2018 Choate ..... A62B 35/0093
10,022,573 B2 * 7/2018 Jones ..... A62B 35/0093
10,029,128 B2 * 7/2018 Lin ..... A62B 35/04
10,413,761 B2 * 9/2019 Hetrich ..... A62B 1/08
10,661,106 B2 * 5/2020 Choate ..... A62B 35/0093
11,779,784 B2 * 10/2023 Shrank ..... A62B 35/0093 182/232
2003/0168545 A1 * 9/2003 Yu ..... B65H 75/406 242/388.1
2005/0051659 A1 * 3/2005 Wolner ..... A62B 35/0093 242/383.5
2009/0178887 A1 * 7/2009 Reeves ..... A62B 1/10 182/239
2010/0226748 A1 * 9/2010 Wolner ..... A62B 35/0093 414/815
2010/0252366 A1 * 10/2010 Jones ..... A62B 35/0093 242/396.5
2011/0209948 A1 * 9/2011 Auston ..... A62B 35/0093 188/68
2012/0118670 A1 * 5/2012 Olson ..... A62B 1/10 182/232
2012/0153064 A1 * 6/2012 Votel ..... B65H 75/4434 242/378.4
2013/0105247 A1 * 5/2013 Casebolt ..... A62B 1/10 188/185
2014/0138186 A1 * 5/2014 Macy ..... A62B 35/0093 182/236
2015/0217151 A1 * 8/2015 Jones ..... F16F 7/123 182/234
2015/0272304 A1 * 10/2015 Hindle ..... A45F 5/021 224/162
2016/0012941 A1 * 1/2016 Ledwith ..... H02G 11/02 156/280
2016/0346572 A1 * 12/2016 Choate ..... A62B 35/0093
2017/0252591 A1 * 9/2017 Hetrich ..... B65H 75/4436
2017/0318788 A1 * 11/2017 Blaylock ..... A45F 5/004
2018/0027775 A1 * 2/2018 Smith ..... A01K 27/004
2018/0028844 A1 * 2/2018 Wu ..... A62B 35/0093
2018/0078795 A1 * 3/2018 Lin ..... A62B 35/04
2018/0161608 A1 * 6/2018 Choate ..... A62B 35/0093
2018/0280740 A1 * 10/2018 Choate ..... A62B 35/0093
2019/0276269 A1 * 9/2019 Castañeda ..... B65H 75/4471
2020/0023211 A1 * 1/2020 Chang ..... A62B 1/10
2020/0205380 A1 * 7/2020 Chung ..... B65H 75/486
2020/0346888 A1 * 11/2020 Kruse ..... A43B 23/0205
2021/0165232 A1 * 6/2021 Zhang ..... G02B 27/0176
2022/0241626 A1 * 8/2022 Yang ..... B65H 75/4442
2023/0228305 A1 * 7/2023 Schrank ..... A62B 35/0093 182/232
2023/0271038 A1 * 8/2023 Schrank ..... A62B 35/0093 182/232
2023/0271039 A1 * 8/2023 Shrank ..... A62B 35/04 182/232

* cited by examiner

RETRACTABLE TOOL LANYARD

CROSS REFERENCE TO RELATED APPLICATIONS

This application claims the benefit of U.S. Provisional Patent Application Ser. No. 63/067,127, filed Aug. 18, 2020, which is incorporated by reference herein.

BACKGROUND

Tools are used by workers in construction, maintenance, and industrial facilities operations. For tasks performed at elevated heights, dropping a tool can cause injury to individuals or damage to objects positioned below the worker. The dropped tool also is a significant inconvenience for workers who must spend time to retrieve the dropped tool.

Lanyards, tethers, and similar restraints are used to prevent accidental dropping of tools. There is a need for a lanyard that is easy to securely connect to a tool and reduces the risk of entanglement during use and nonuse of the tool. There is a need for a lanyard to reduce the distance a tool falls and to reduce the dynamic load applied to the user through the connection point on the user, such as the user's tool belt, vest, or harness. There is also a need for a lanyard that provides indication should a tool drop occur.

For the reasons stated above and for other reasons stated below, which will become apparent to those skilled in the art upon reading and understanding the present specification, a need exists for the present invention.

SUMMARY

The above-mentioned problems associated with prior devices are addressed by embodiments of the disclosure and will be understood by reading and understanding the present specification. The following summary is made by way of example and not by way of limitation.

In one embodiment, a retractable tool lanyard comprises a housing defining a cavity, a drum rotatably connected to the housing within the cavity, a biasing member interconnecting the housing and the drum, a cord operatively connected to the drum and configured and arranged to be wound about and paid out from the drum, the biasing member urging the cord to be wound about the drum, an engaging mechanism operatively connected to the drum, and at least one of a braking mechanism and a clicker pawl. The engaging mechanism comprises a locking plate connected to the drum, at least one lock pawl pivotally connected to the locking plate, the at least one lock pawl pivotable from an unlocked position to a locked position, wherein when the drum rotates at a predetermined speed as the cord is paid out from the drum the at least one lock pawl pivots from the unlocked position to the locked position, and a ratchet plate including a ratchet ring on a first side, the at least one lock pawl configured and arranged to engage the ratchet ring when in the locked position thereby rotating the ratchet plate with the drum. The braking mechanism includes at least one brake pad positioned between the ratchet plate and the housing, and the at least one brake pad is configured and arranged to create friction on the ratchet plate when the ratchet plate rotates to assist in reducing a rate of rotation of the ratchet plate and thereby the drum. The clicker pawl is pivotally connected to the housing and is configured and arranged to selectively engage a star ring on a second side of the ratchet plate. The clicker pawl provides a braking force and produces audible indication when the at least one lock pawl is in the locked position and the ratchet plate rotates with the drum.

In one embodiment, a retractable tool lanyard comprises a housing defining a cavity, a drum rotatably connected to the housing within the cavity, a biasing member interconnecting the housing and the drum, a cord operatively connected to the drum and configured and arranged to be wound about and paid out from the drum, the biasing member urging the cord to be wound about the drum, an engaging mechanism operatively connected to the drum, and a braking mechanism. The engaging mechanism comprises a locking plate connected to the drum, at least one lock pawl pivotally connected to the locking plate, and a ratchet plate. The at least one lock pawl is pivotable from an unlocked position to a locked position, and when the drum rotates at a predetermined speed, for example as the cord is paid out from the drum, the at least one lock pawl pivots from the unlocked position to the locked position. The ratchet plate includes a ratchet ring on a first side, and the at least one lock pawl is configured and arranged to engage the ratchet ring when in the locked position thereby rotating the ratchet plate with the drum. The braking mechanism comprises at least one brake pad positioned between the ratchet plate and the housing, and the at least one brake pad is configured and arranged to create friction on the ratchet plate when the ratchet plate rotates to assist in reducing a rate of rotation of the ratchet plate and thereby the drum.

In one embodiment, a retractable tool lanyard comprises a housing defining a cavity, a drum rotatably connected to the housing within the cavity, a biasing member interconnecting the housing and the drum, a cord operatively connected to the drum and configured and arranged to be wound about and paid out from the drum, the biasing member urging the cord to be wound about the drum, and an engaging mechanism operatively connected to the drum. The engaging mechanism comprises a locking plate connected to the drum, at least one lock pawl pivotally connected to the locking plate, the at least one lock pawl pivotable from an unlocked position to a locked position, a ratchet plate, and at least one clicker pawl pivotally connected to the housing. The ratchet plate includes a ratchet ring on a first side and a star ring on a second side, the at least one lock pawl configured and arranged to engage the ratchet ring when in the locked position thereby rotating the ratchet plate with the drum. When the drum rotates at a predetermined speed, for example as the cord is paid out from the drum, the at least one lock pawl pivots from the unlocked position to the locked position. The at least one clicker pawl is configured and arranged to selectively engage the star ring, and the at least one clicker pawl provides a braking force and produces audible indication when the at least one lock pawl is in the locked position and the ratchet plate rotates with the drum.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. In accordance with common practice, the various described features are not drawn to scale but are drawn to emphasize specific features relevant to the present disclosure. Reference characters denote like elements throughout the Figures and the text.

DETAILED DESCRIPTION

Figure 1:
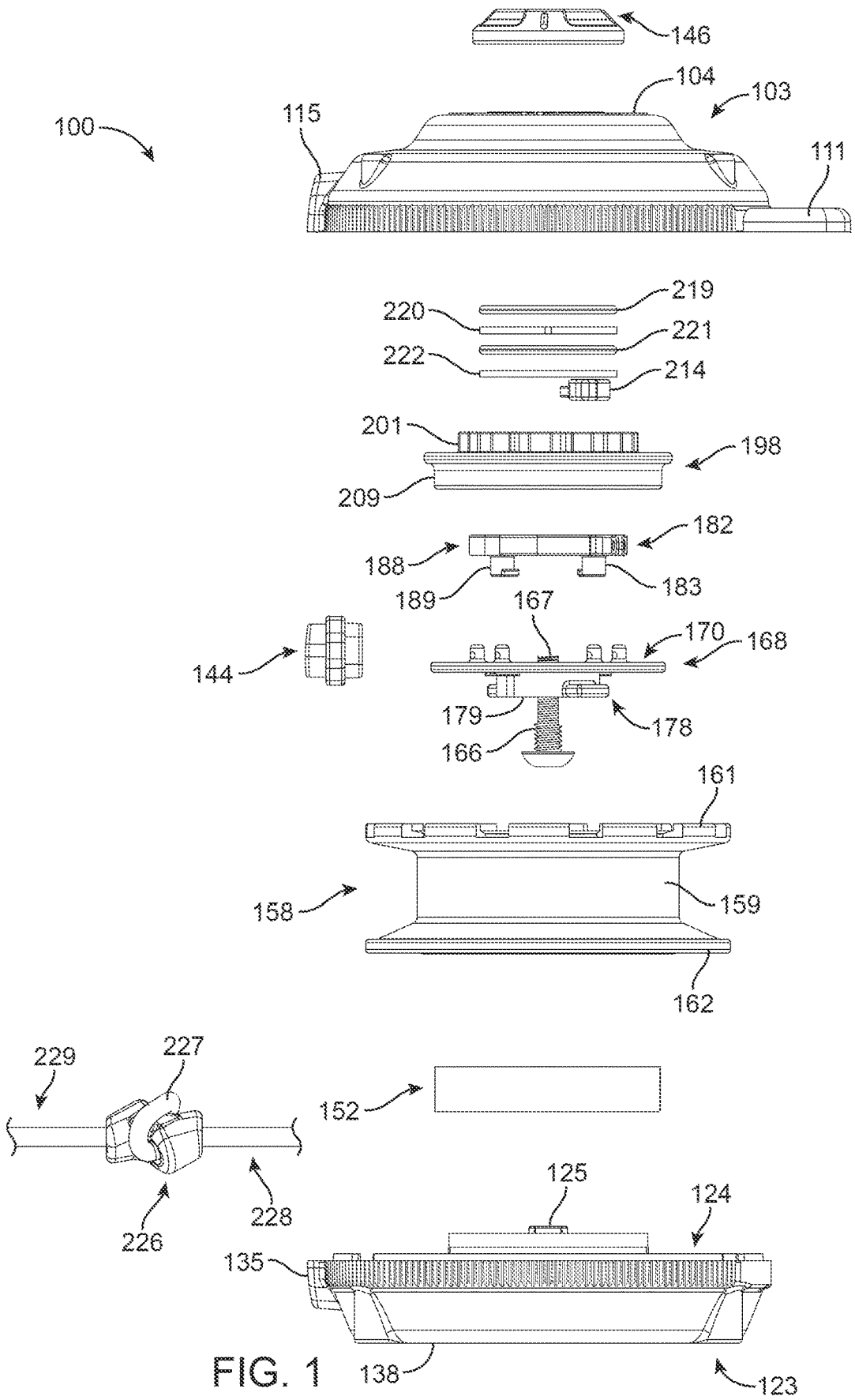
FIG. 1 is an exploded side view of a retractable tool lanyard constructed in accordance with the principles of the present invention.
Figure 2:
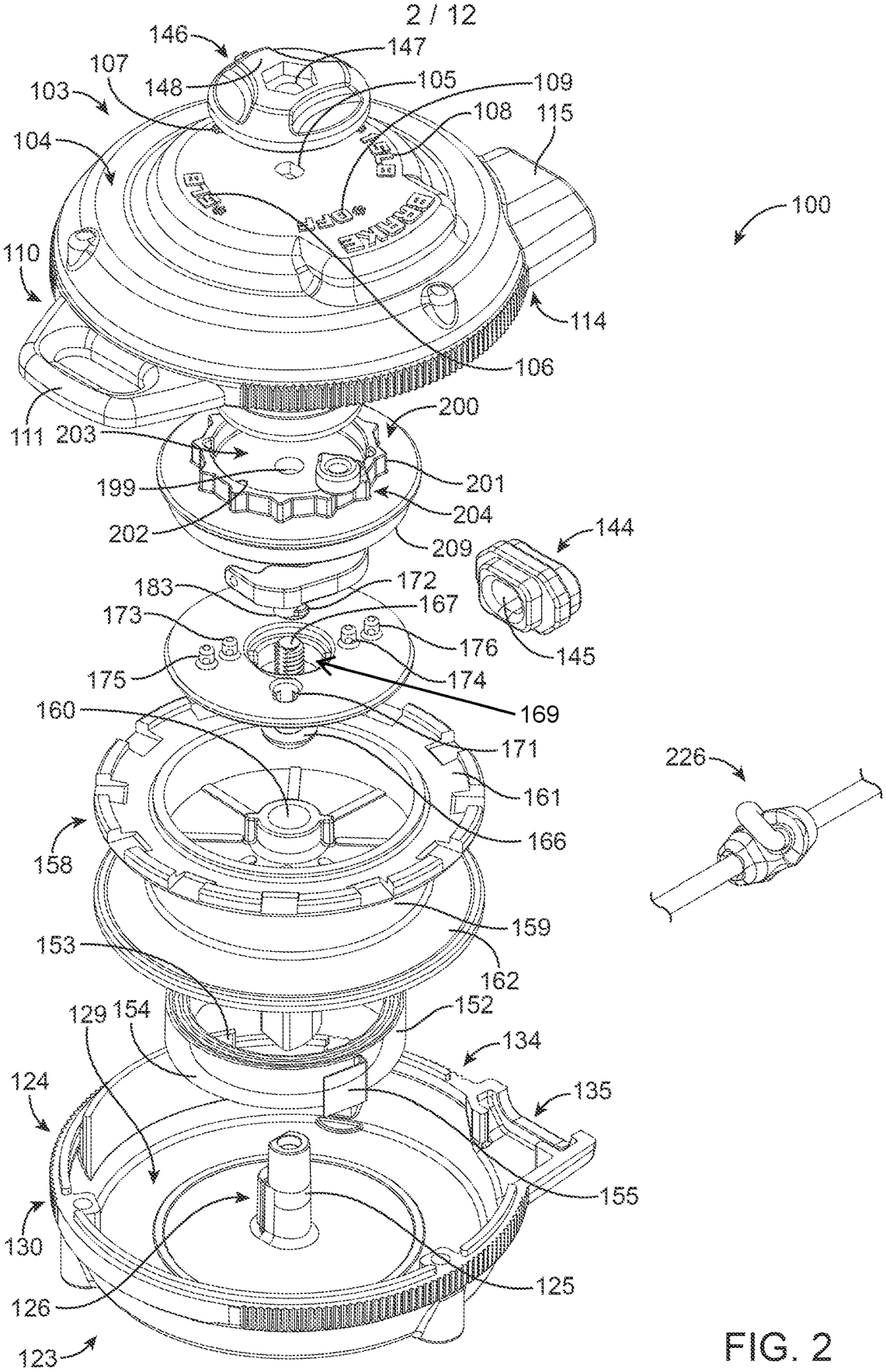
FIG. 2 is an exploded front perspective view of the retractable tool lanyard shown in FIG. 1.
Figure 3:
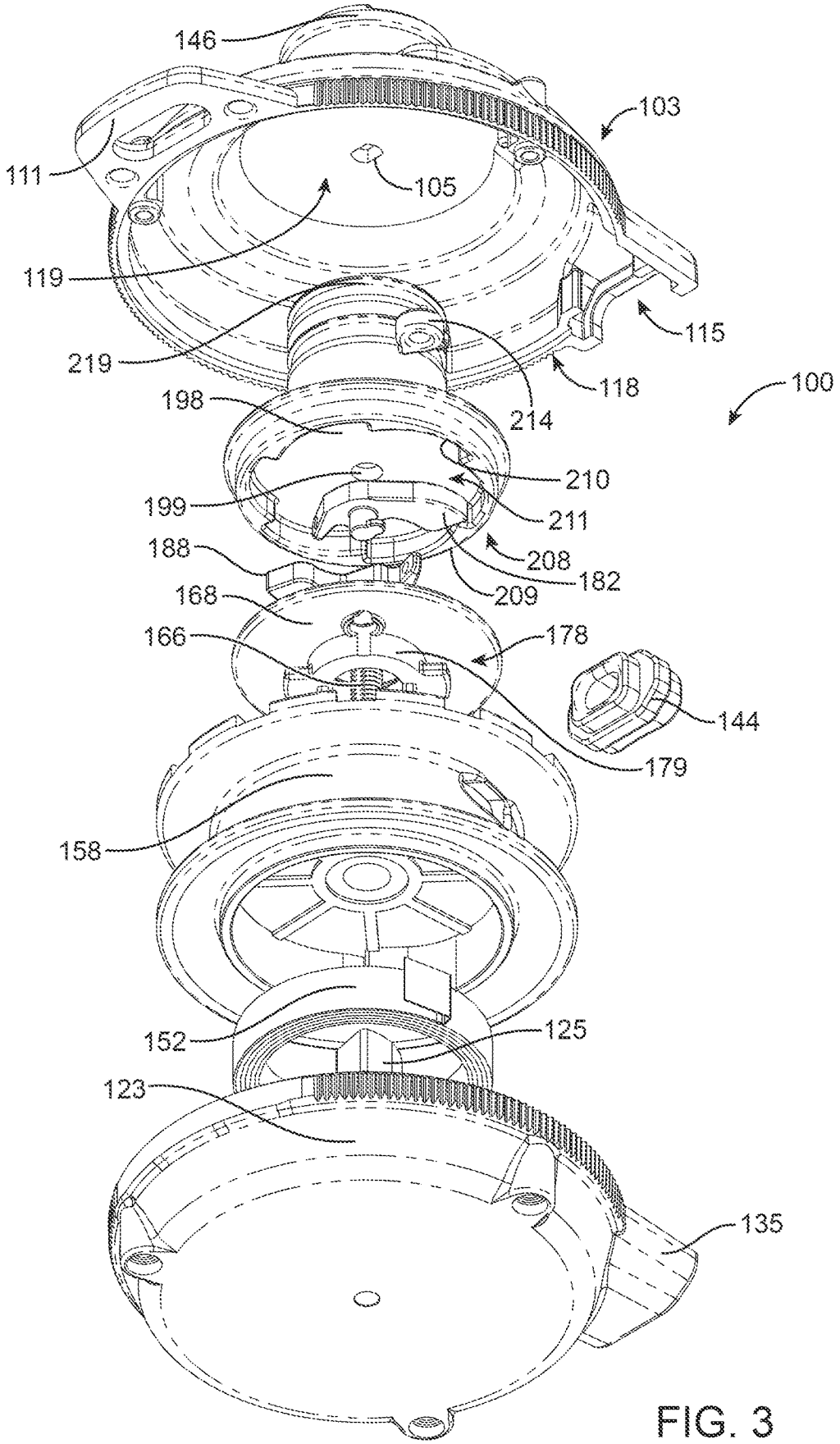
FIG. 3 is an exploded rear perspective view of the retractable tool lanyard shown in FIG. 1.

In the following detailed description, reference is made to the accompanying drawings, which form a part hereof, and in which is shown by way of illustration embodiments in which the disclosure may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that other embodiments may be utilized and mechanical changes may be made without departing from the spirit and scope of the present disclosure. The following detailed description is, therefore, not to be taken in a limiting sense.

Embodiments of the disclosure generally provide a retractable tool lanyard that reduces a rate at which a tool falls should a tool drop occur thereby reducing an amount of force exerted upon a user to which the retractable tool lanyard is connected.

An example retractable tool lanyard 100 generally includes a housing 102 forming a cavity 140 in which a drum 158, a locking plate 168, lock pawls 182 and 188, a ratchet plate 198, and a clicker pawl 214 are positioned. Optionally, brake pads 219, 220, 221, and 222 are also positioned within the cavity 140. Generally, an elongate member, such as a cord 226 or other suitable elongate member, is operatively connected to the drum 158, wound about the drum 158, and extends out of the housing 102 for connection to a tool. The cord 226 is paid out from the housing 102 as it unwinds from the drum 158 and retracts into the housing 102 as it winds about the drum 158 during use.

The housing 102 includes a first housing portion 103 and a second housing portion 123. The first housing portion 103 has a top 104 with an aperture 105 about which a first position indicator 106, a second position indicator 107, a third position indicator 108, and a fourth position indicator 109 are positioned. On a first side 110, proximate a bottom 118 of the first housing portion 103 is a handle 111 extending outward therefrom. On a generally opposing, second side 114 of the first housing portion 103 is a first channel portion 115. The first housing portion 103 is configured and arranged to form a first cavity portion 119 to which there is an opening proximate the bottom 118 of the first housing portion 103.

Figure 4:
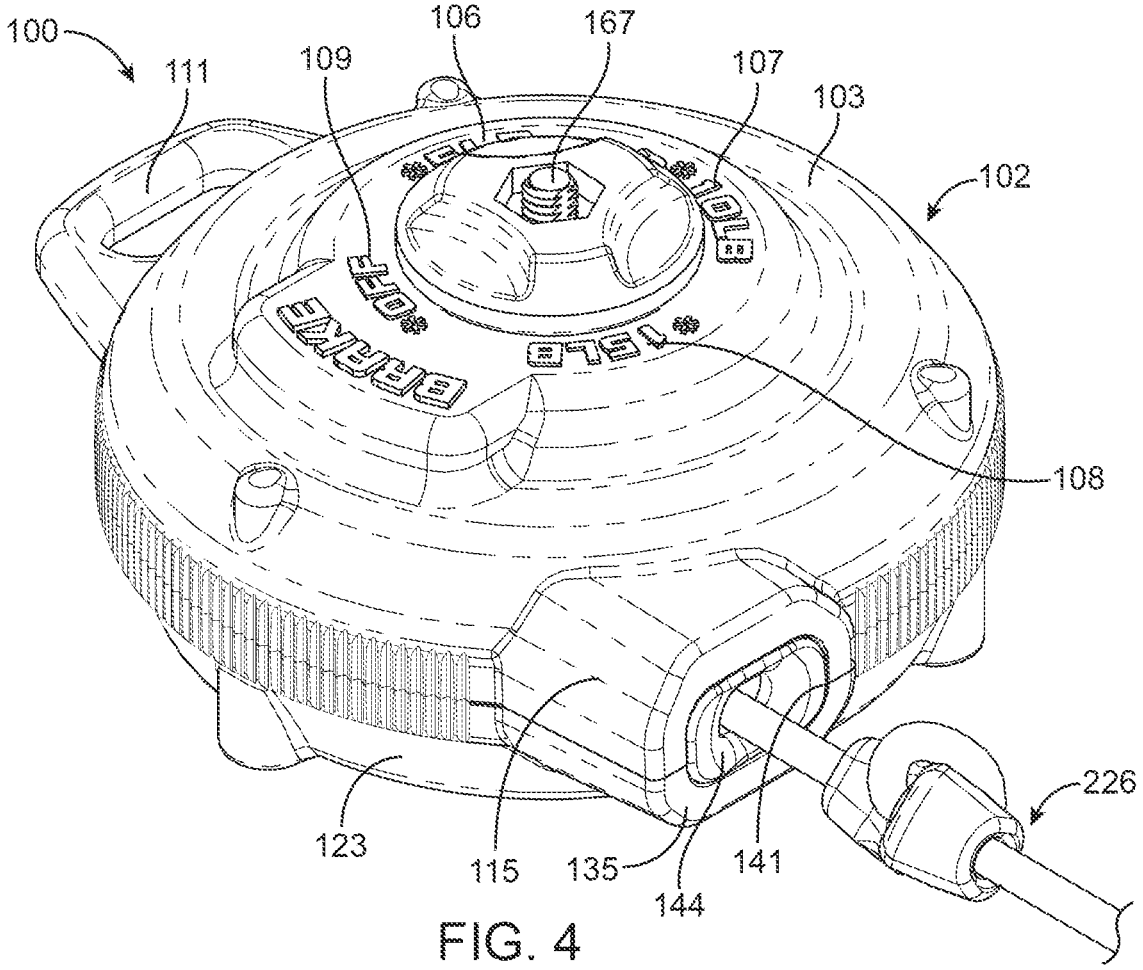
FIG. 4 is a front perspective view of the retractable tool lanyard shown in FIG. 1.

The second housing portion 123 is configured and arranged to form a second cavity portion 129 to which there is an opening proximate a top 124 of the second housing portion 123. The first cavity portion 119 and the second cavity portion 129 form the cavity 140, shown in FIG. 12. A shaft 125 extends upward from an inside surface of the second housing portion 123, proximate a bottom 138, and the shaft 125 includes a slot 126. A first side 130 corresponds with the first side 110 of the first housing portion 103 but does not include a handle. Optionally, first side 130 could include a corresponding handle portion to form a handle. A second side 134 corresponds with the second side 114 of the first housing portion 103 and includes a corresponding second channel portion 135. A channel 141, shown in FIG. 4, is formed by first channel portion 115 and second channel portion 135. The channel 141 is configured and arranged to receive a cord guide 144 through which a bore 145 extends.

A drum 158 includes a base 159, which is generally cylindrical with a bore 160, and first and second sides 161 and 162 extend outward from opposing sides of the base 159. The bore 160 is configured and arranged to receive the shaft 125 of the second housing portion 123, and the drum 158 is rotatable about the shaft 125 relative to the housing 102. The base 159 includes a first cavity proximate the first side 161 and a second cavity proximate the second side 162. A biasing member 152, such as a motor spring, is received in the second cavity and interconnects the drum 158 and the housing 102 to place a biasing force on the drum 158 to urge the drum 158 to rotate in a direction that winds the cord 226 about the drum 158, retracting the cord 226 into the housing 102. A first end 153 of the biasing member 152 is received in the slot 126 of the shaft 125, and a second end 155 of the biasing member 152 is received in a slot (not shown) in the base 159.

A proximal end 228 of a cord 226 is operatively connected to the base 159, an intermediate portion of the cord 226 is wound about the base 159, and a distal end 229 extends outwardly from the base 159 and through the channel 141 of the housing 102 and the bore 145 of the cord guide 144. The cord guide 144 acts as a wear pad. A grommet 227 may be connected to the cord 226 proximate the distal end 229 to act as a stop, preventing the distal end 229 from being retracted into the housing 102. As the cord 226 is paid out from the drum, an intermediate portion 154 of the biasing member 152 is wound tighter, and when a pulling force is released from the cord 226, the biasing member 152 unwinds thereby winding the cord 226 about the drum 158 and retracting the cord 226 into the housing 102.

A locking plate 168 includes a disk-shaped base with a top 170 and a bottom 178 through which a bore 169 extends. The top 170 includes a first pawl receiver 171 on one side and a second pawl receiver 172 on an opposing side of the bore 169. Between the pawl receivers 171 and 172 are a first inner boss 173 and a first outer boss 175 on one side and a second inner boss 174 and a second outer boss 176 on an opposing side of the bore 169. The bottom 178 includes a boss 179 extending about the bore 169. The locking plate 168 is configured and arranged to be received within the first cavity proximate the first side 161 of the drum 158.

A first lock pawl 182 and a second lock pawl 188 are pivotally connected to the locking plate 168. The first lock pawl 182 includes a base from which a connecting portion 184 and an engaging portion 185 extend in opposing directions from one another. An extension 183 extends downward from the base and is configured and arranged to be received within the first pawl receiver 171 to provide a pivotable connection between the first lock pawl 182 and the locking plate 168. A biasing member 186 interconnects the connecting portion 184 and the first outer boss 175 of the locking plate 168 to bias the first lock pawl 182 in an unlocked position. Similarly, the second lock pawl 188 includes a base from which a connecting portion 190 and an engaging portion 191 extend in opposing directions from one another. An extension 189 extends downward from the base and is configured and arranged to be received within the second pawl receiver 172 to provide a pivotable connection between the second lock pawl 188 and the locking plate 168. A biasing member 192 interconnects the connecting portion 190 and the second outer boss 176 of the locking plate 168 to bias the second lock pawl 188 in an unlocked position. Although two pawls are shown and described, it is recognized that one or more pawls could be used.

A ratchet plate 198 includes a disk-shaped base with a top 200 and a bottom 208 through which a bore 199 extends. A star ring 201 is operatively connected to the top 200, and a ratchet ring 209 is operatively connected to the bottom 208. The star ring 201 includes an opening 202, and a cavity 203 is defined by the top 200 and the star ring 201, with the opening 202 providing access to the cavity 203. An outer perimeter of the star ring 201 includes teeth 204. The ratchet ring 209 includes an opening 210, and a cavity 211 is defined by the bottom 208 and the ratchet ring 209, with the opening 210 providing access to the cavity 211. An inner perimeter of the ratchet ring 209 includes teeth 212. The cavity 211 is configured and arranged to receive the first and second lock pawls 182 and 188, and when the first and second lock pawls 182 and 188 move from unlocked positions to locked positions, the first and second lock pawls engage the teeth 212.

Figure 8:
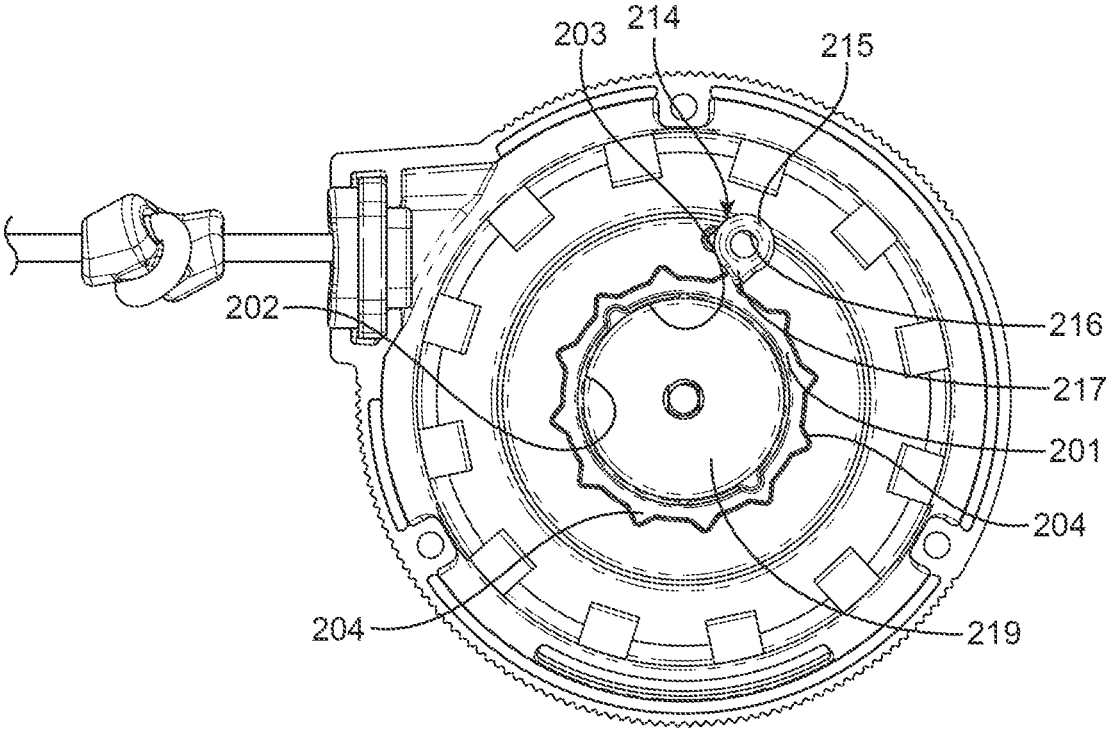
FIG. 8 is a front view of the retractable tool lanyard shown in FIG. 1 with a knob and a first housing portion removed.
Figure 9:
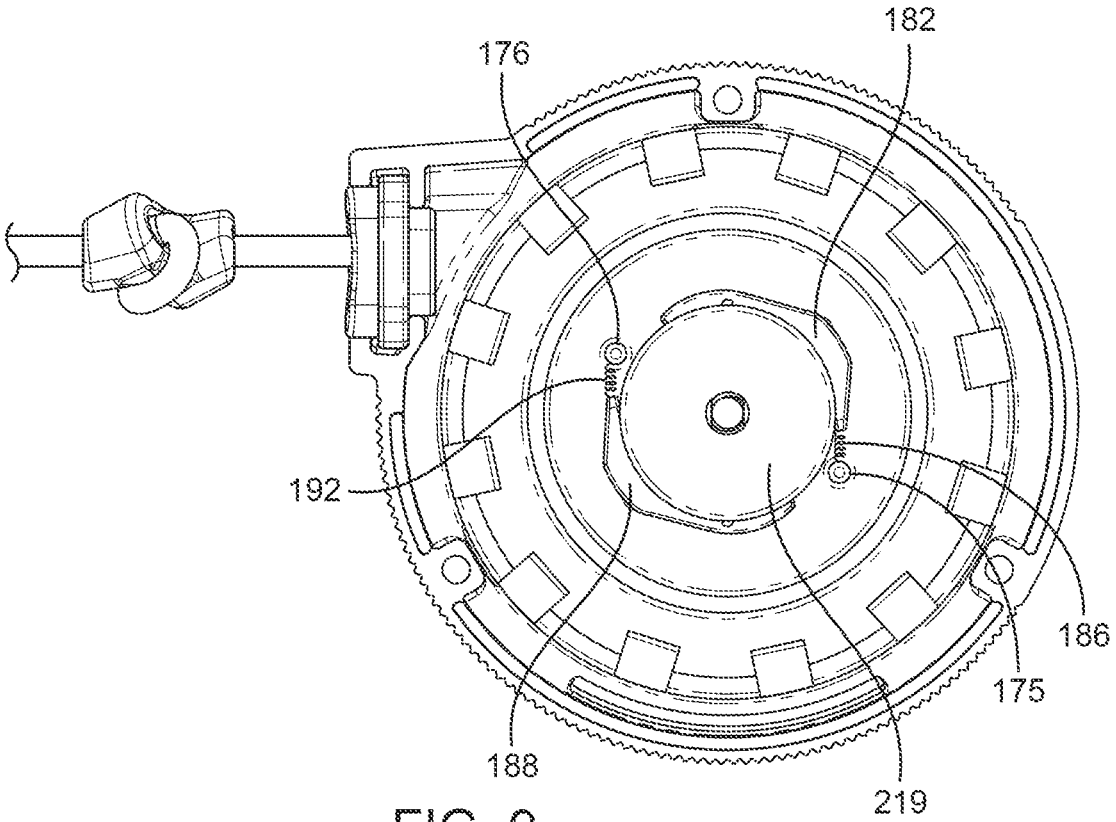
FIG. 9 is a front view of the retractable tool lanyard shown in FIG. 1 shown in FIG. 8 with a clicker pawl and a ratchet plate removed.
Figure 10:
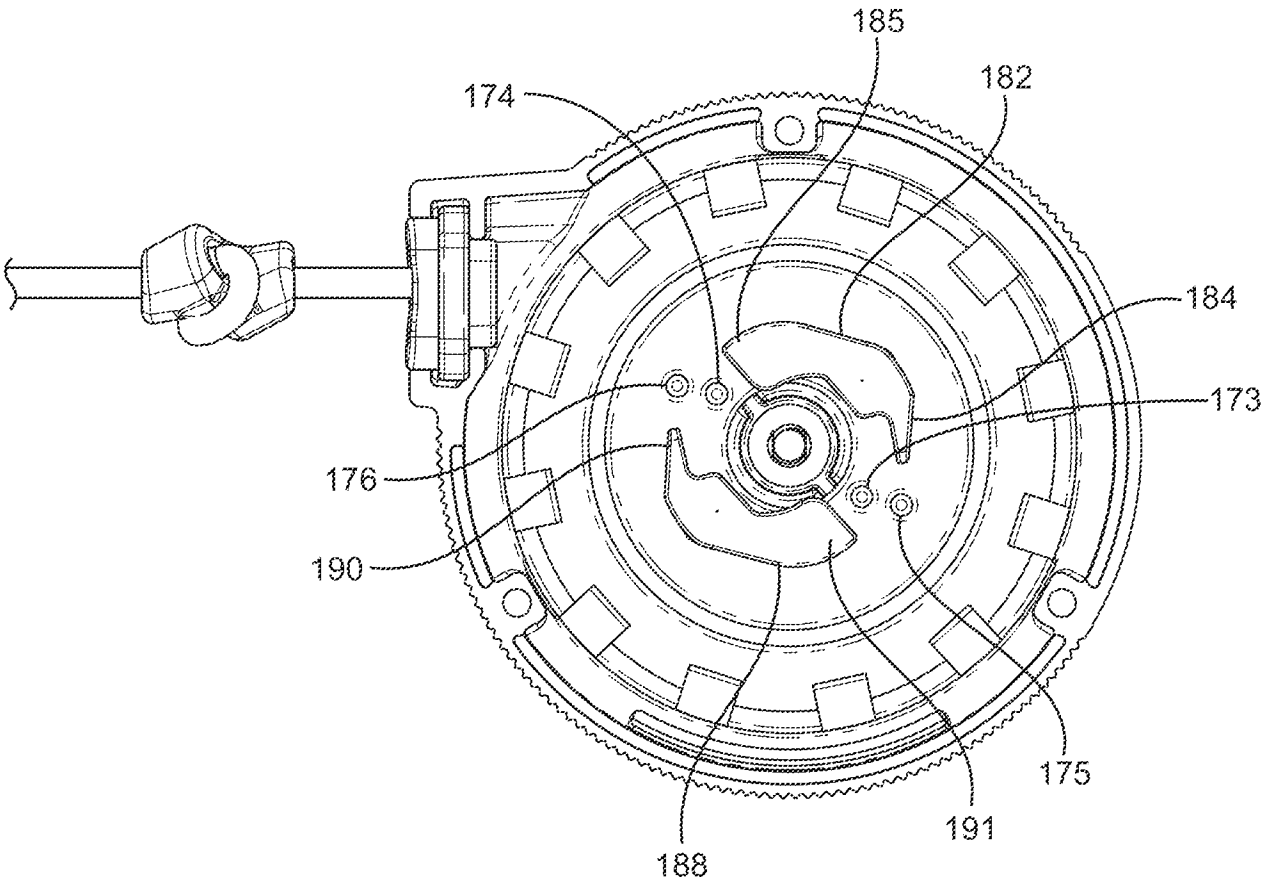
FIG. 10 is a front view of the retractable tool lanyard shown in FIG. 1 shown in FIG. 9 with brake pads removed.
Figure 11:
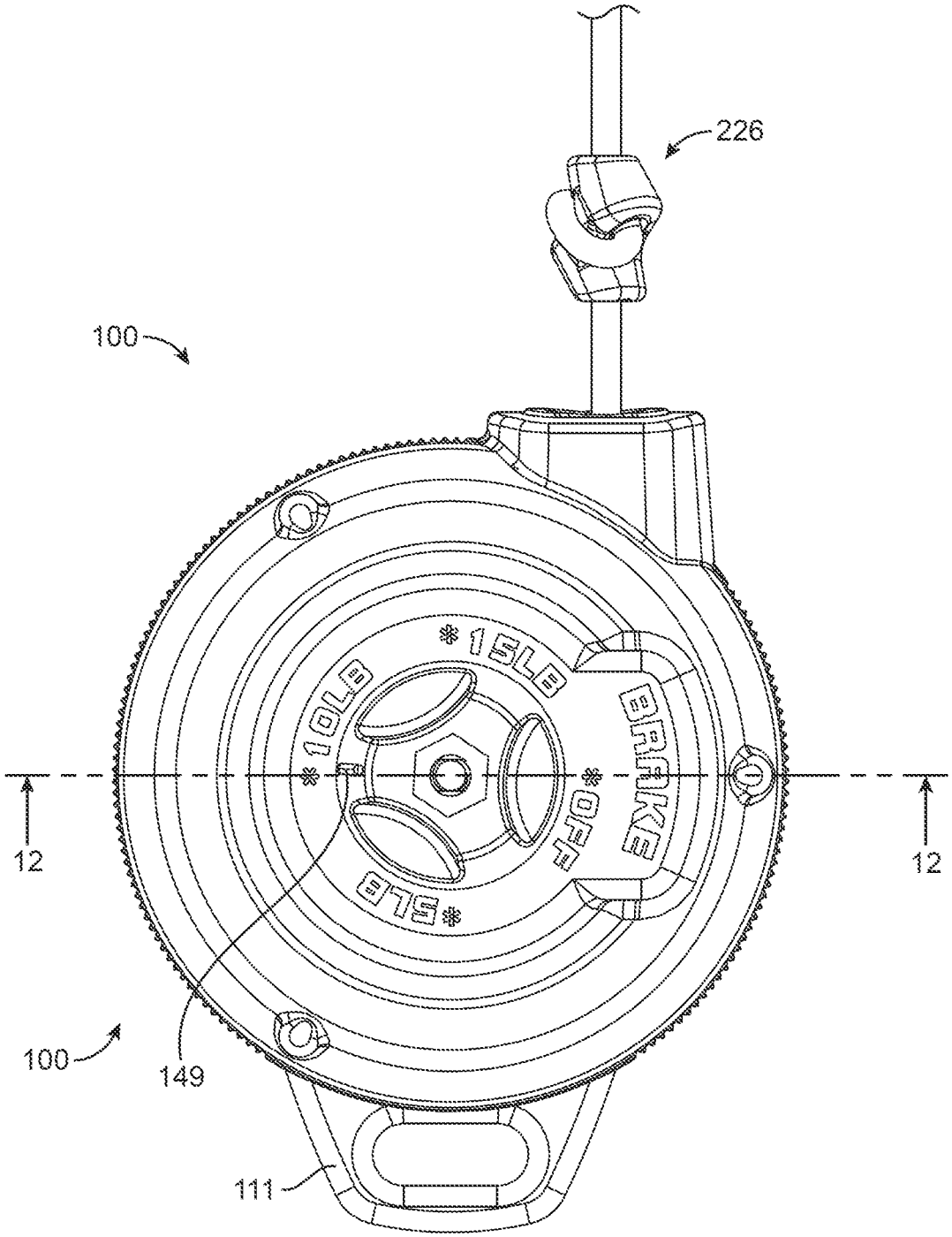
FIG. 11 is a front view of the retractable tool lanyard shown in FIG. 1.

A clicker pawl 214 includes a connecting portion 215 configured and arranged to pivotally connect to the first housing portion 103. A bore 216 in the connecting portion 215 receives a post (not shown) extending from an inner surface of the first housing portion 103. A biasing member 218 interconnects the connecting portion 215 and the first housing portion 103 to place a biasing force on the clicker pawl 214. An engaging portion 217 extends outward from the connecting portion 215. The engaging portion 217 of the clicker pawl 214 is configured and arranged to selectively engage the teeth 204 of the star ring 201 as an engaging mechanism. FIG. 8 is a top view with the first housing portion 103 removed to show the star ring 201 and the clicker pawl 214. It is recognized that more than one clicker pawl 214 can be used.

Optionally, a braking mechanism could be included in addition to the clicker pawl 214 or in lieu of the clicker pawl 214. If used with the clicker pawl 214, although the clicker pawl 214 provides some braking force or resistance, additional braking force may be desired. Brake pads are configured and arranged to partially fit within the cavity 203 of the star ring 201 between the top 200 and the inner surface of the first housing portion 103. For example, the brake pads could include a first brake pad 219, a second brake pad 220, a third brake pad 221, and a fourth brake pad 222. The first and third brake pads 219 and 221 could be made of cotton and the second and fourth brake pads 220 and 222 could be made of steel, or the first and third brake pads 219 and 221 could be made of steel and the second and fourth brake pads 220 and 222 could be made of cotton. It is recognized that other types of brake pads could be used.

Figure 5:
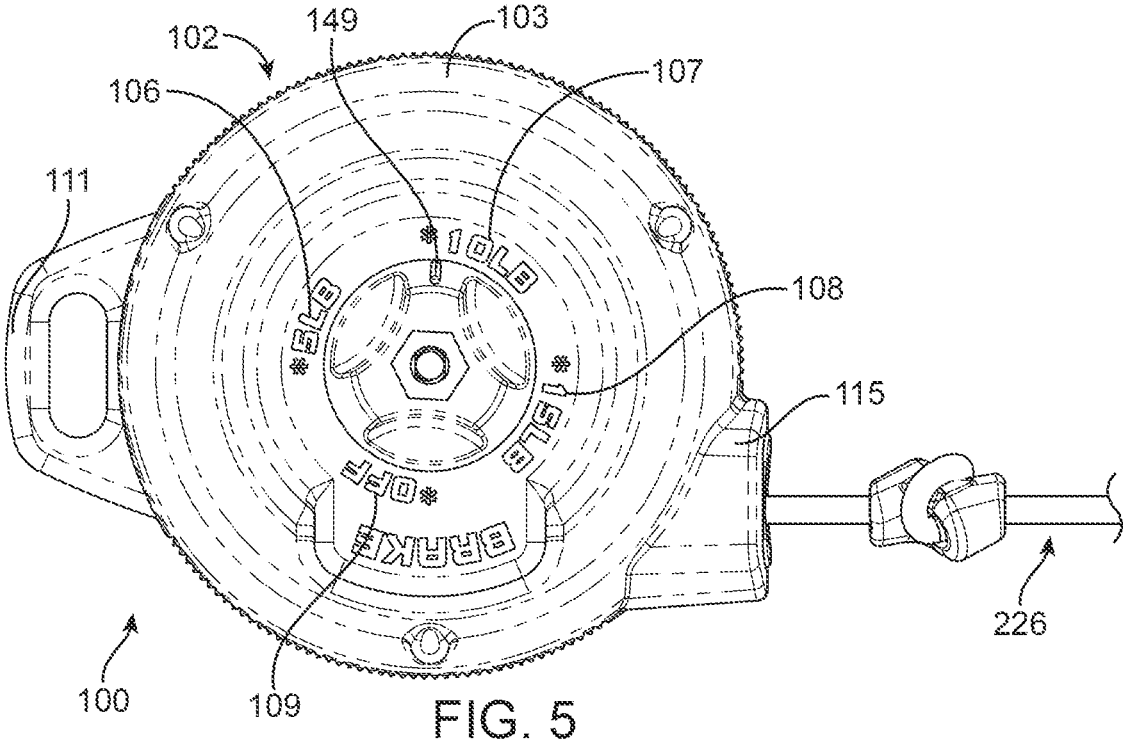
FIG. 5 is a front view of the retractable tool lanyard shown in FIG. 1.
Figure 6:
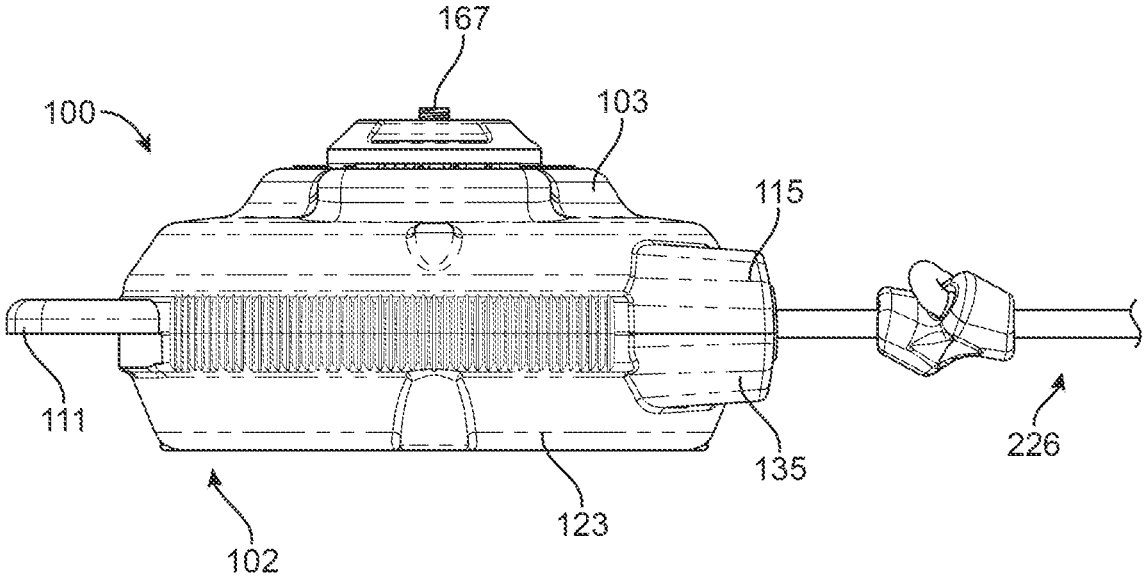
FIG. 6 is a side view of the retractable tool lanyard shown in FIG. 1.
Figure 7:
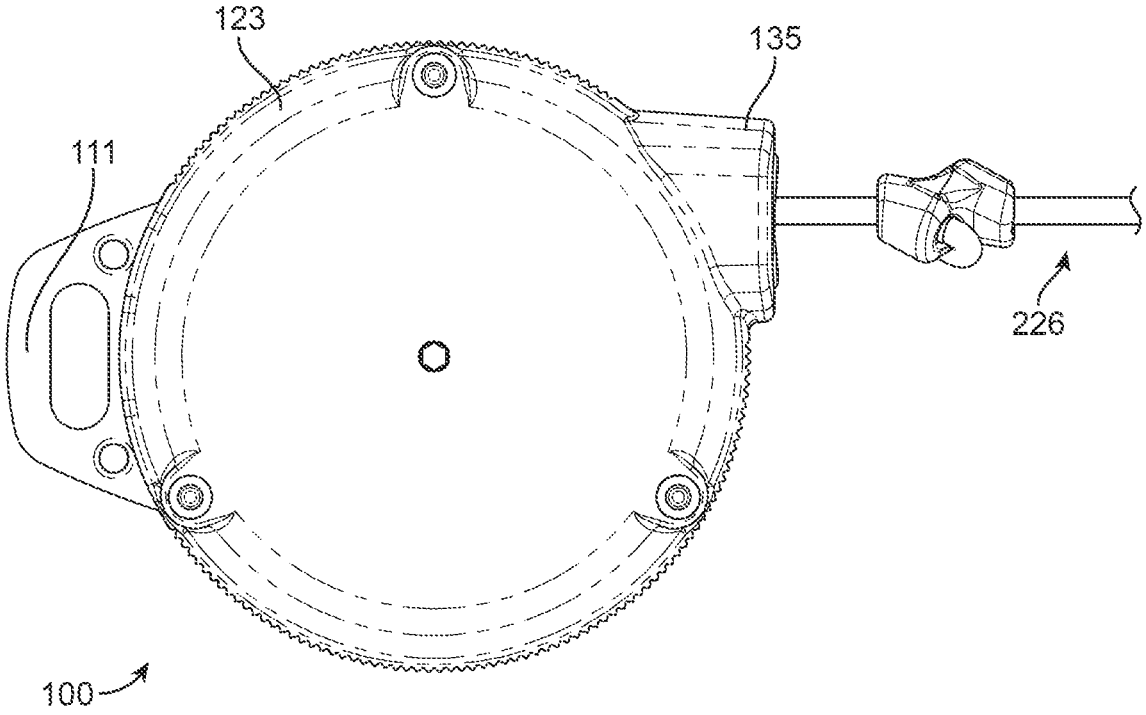
FIG. 7 is a rear view of the retractable tool lanyard shown in FIG. 1.
Figure 12:
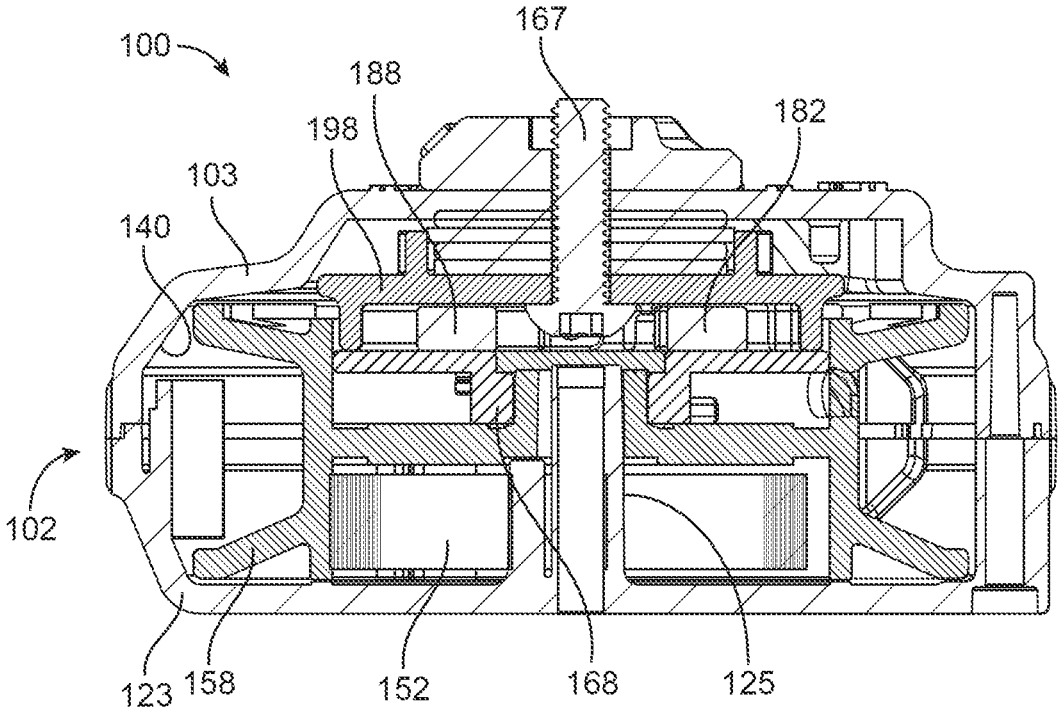
FIG. 12 is a cross section view of the retractable tool lanyard shown in FIG. 1 taken along the lines 12-12 in FIG. 11.
Figure 13:
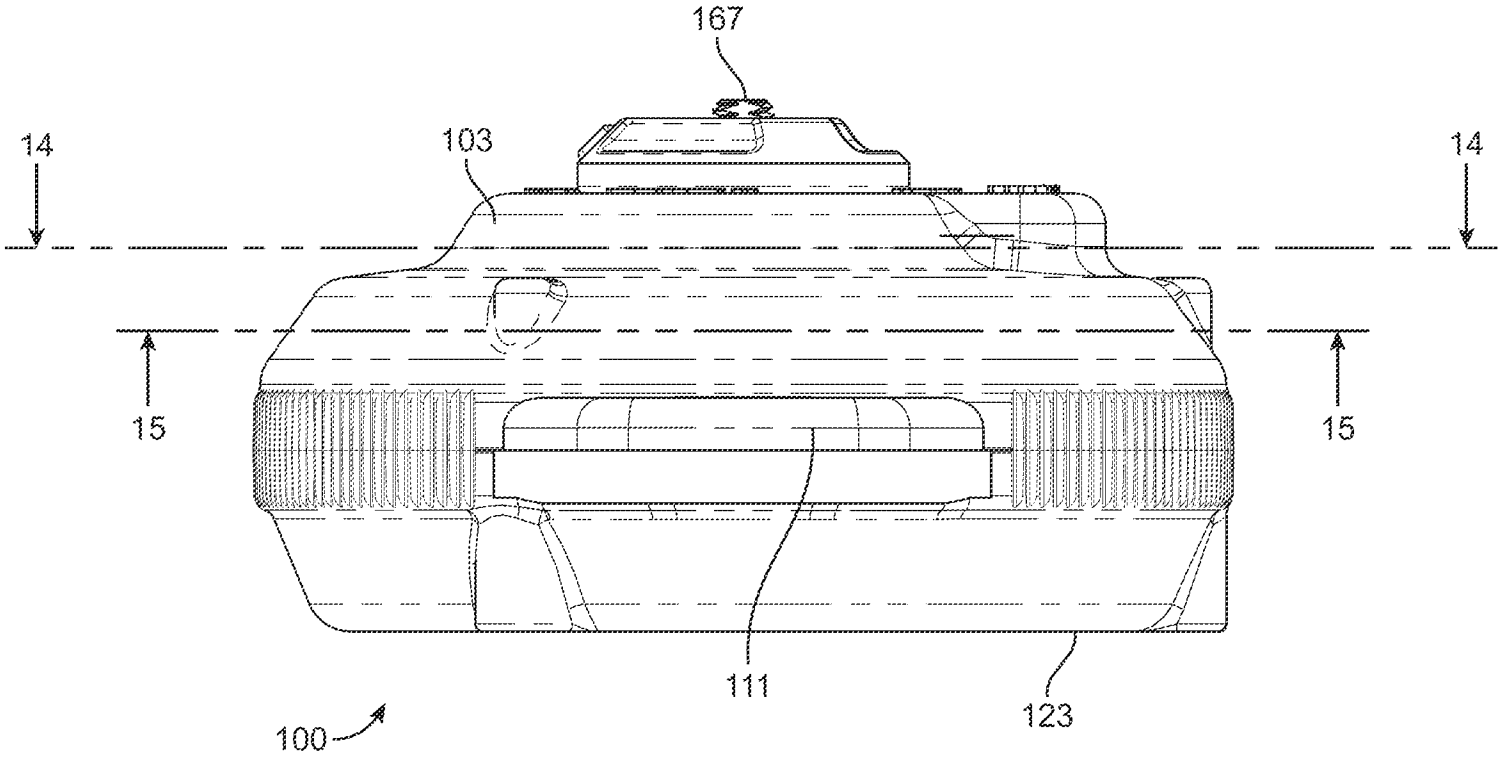
FIG. 13 is a top view of the retractable tool lanyard shown in FIG. 1.
Figure 14:
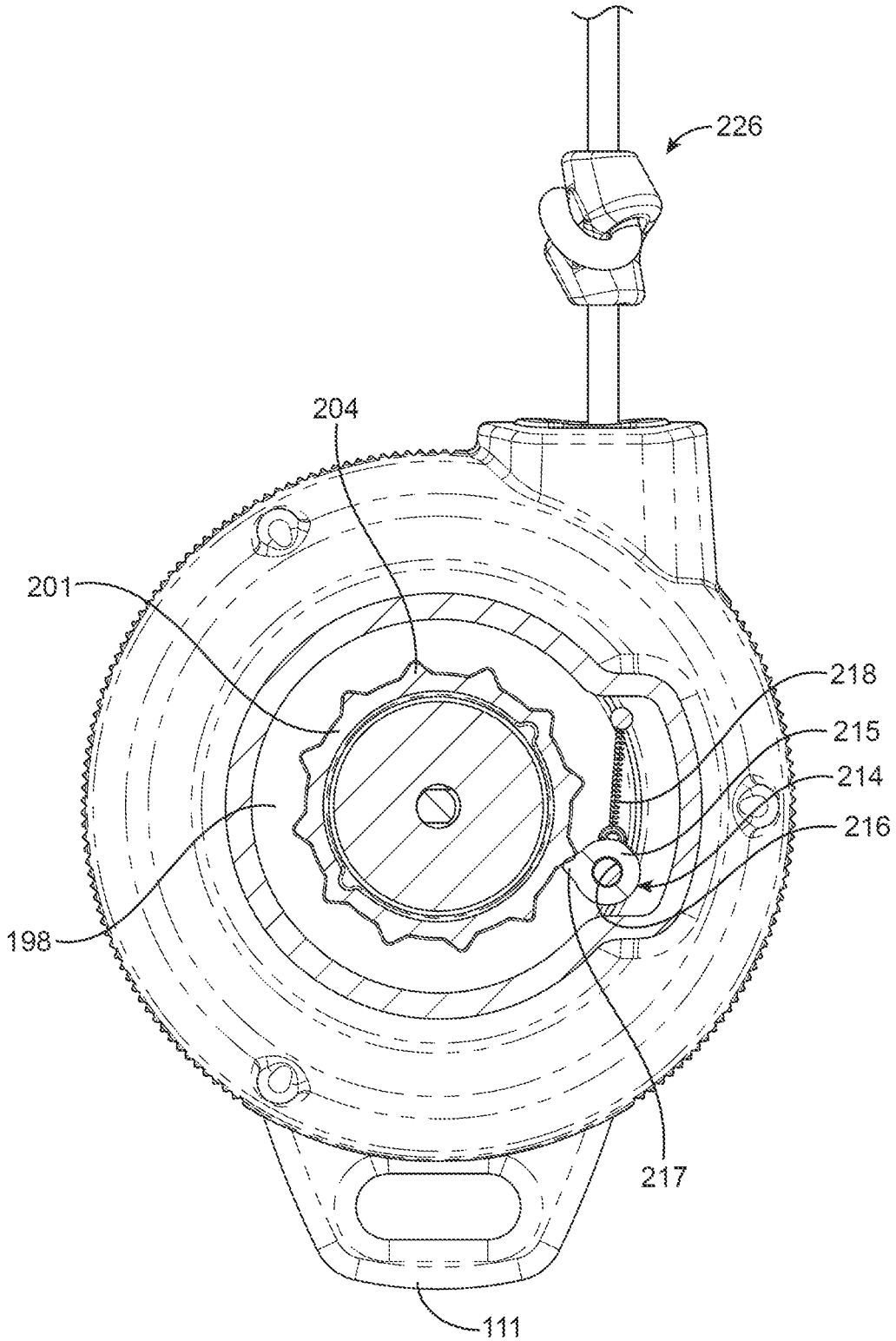
FIG. 14 is a cross section view of the retractable tool lanyard shown in FIG. 1 taken along the lines 14-14 in FIG. 13.
Figure 15:
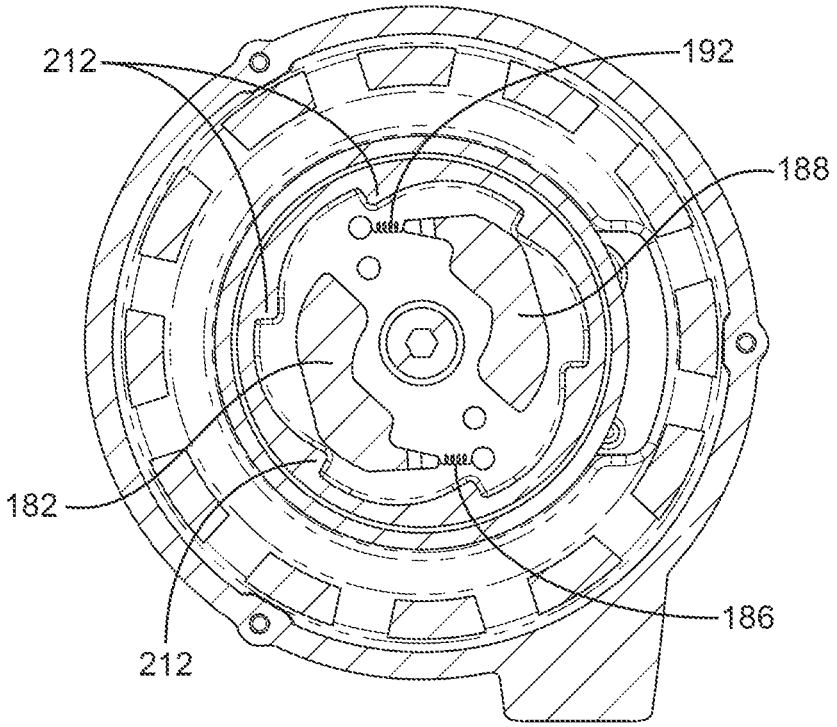
FIG. 15 is a cross section view of the retractable tool lanyard shown in FIG. 1 taken along the lines 15-15 in FIG. 13 with pawls in unlocked positions.
Figure 16:
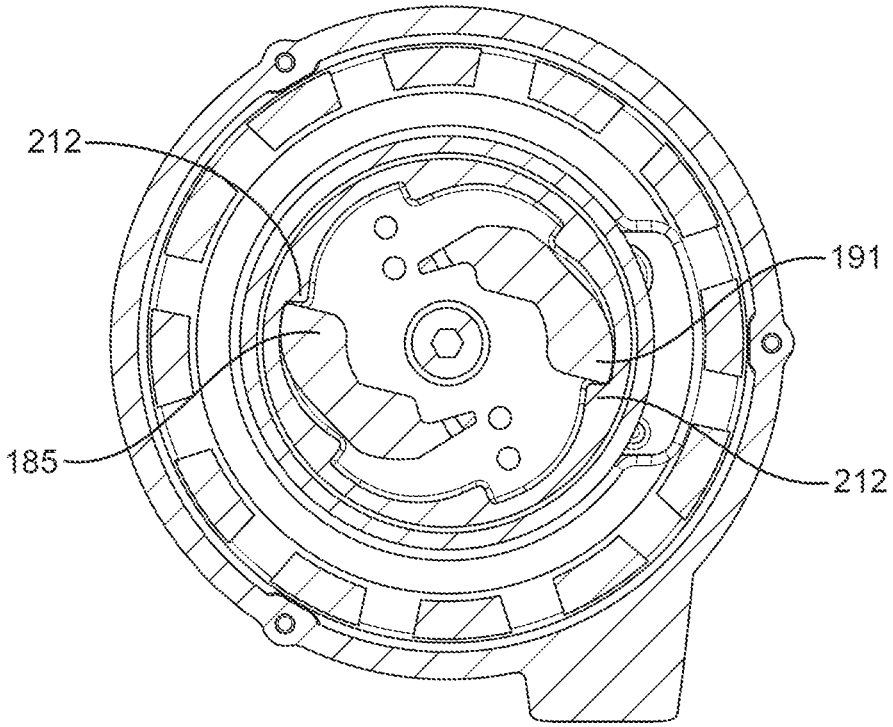
FIG. 16 is a cross section view of the retractable tool lanyard shown in FIG. 1 shown in FIG. 15 with pawls in locked positions.

As shown in FIG. 12, a fastener 166 with a threaded shaft extends through the ratchet plate 198, the brake pads, and the aperture 105 of the first housing portion 103. A distal end 167 of the fastener 166 extends through the aperture 105 and out of the first housing portion 103. A knob 146 includes a threaded bore 147 configured and arranged to receive the distal end 167 of the fastener 166. A top 148 of the knob 146 includes a knob indicator 149 that provides indication in which position the braking mechanism is. Examples of position indicators include the first position indicator 106 for a five pound tool, the second position indicator 107 for a ten pound tool, the third position indicator 108 for a fifteen pound tool, and the fourth position indicator 109 for an "off" position. These adjustment positions are indicative and the loads may vary or adjustments may not be present in a preferred iteration. FIG. 5 illustrates the knob indicator 149 and the second position indicator 107 aligned. As the knob 146 is moved along the shaft toward the proximal end of the fastener 166, the components are compressed more tightly thereby increasing friction. For less friction, the knob 146 is positioned closer to the distal end 167.

In operation, during normal use, the user grabs the tool (not shown) connected to the distal end 229 of the cord 226 and pulls the tool away from the housing 102, which pays out the cord 226, rotating the drum 158 to unwind the cord 226 from the drum 158, and tightening the coil of the biasing member 152. When the user releases the tool or moves the tool toward the housing 102, the biasing member 152 will bias the drum 158 to rotate and wind the cord 226 about the drum 158. Because excess cord 226 is retracted into the housing 102, risks the cord 226 will get caught on something, the cord 226 will get entangled in other personal protective equipment, and the user will trip on the cord 226 are reduced.

Should a tool drop occur, or the user pulls the cord 226 rapidly, the drum 158 and the locking plate 168 rotate at a rate that overcomes the biasing force of the biasing members 186 and 192 on the lock pawls 182 and 188, and the lock pawls 182 and 188 pivot so that the engaging portions 185 and 191 move outward and engage the teeth 204 of the ratchet plate 198. When the engaging portions 185 and 191 engage the teeth 204, the ratchet plate 198 rotates with the drum 158. When the ratchet plate 198 rotates, the clicker pawl 214 contacts the teeth 204 of the star ring 201. An audible indication is provided by the engaging mechanism, which includes the clicker pawl 214 and the star ring 201. In addition, the contact between the clicker pawl 214 and the star ring 201 provides resistance to rotation of the ratchet plate 198 (and therefore the locking plate 168 and the drum 158) thereby assisting in slowing down the rate at which the cord 226 is paid out from the drum 158.

The retractable tool lanyard 100 preferably does not suddenly stop the tool from dropping within a desired distance. The rate at which the tool drops is preferably gradually reduced. If a braking mechanism is used in addition to or in lieu of the clicker pawl 214, the braking mechanism provides resistance to slow the rate of the tool drop. For heavier tools, the tool may not stop until the cord 226 has been paid out so that the drum 158 no longer rotates. The gradual rate reduction of the drop assists in reducing the amount of force exerted upon the tool or user thereby preventing damage to the tool or user. Reducing the amount of force exerted on the user reduces the risk of the user losing their balance and falling or becoming injured. This also allows for a lighter weight housing to be used such as plastic. The tool drop may be stopped by the user catching the tool or grabbing the cord 226, by the engaging mechanism and, if used, the braking mechanism, or by paying out the cord 226 until the drum stops rotating.

The amount of friction between the components of the braking mechanism (e.g., the locking plate 168, the ratchet plate 198, the brake pads, and the first housing portion 102) is easily adjusted by rotating the knob 146. The knob 146 and the fastener 166 act as an adjuster to increase and decrease the amount of friction between the components. When the knob 146 is rotated in a first direction about the shaft of the fastener 166, the components are moved closer together thereby increasing pressure and friction between the components. For lighter weight tools, it may be desired to decrease the amount of friction between the components so that the tool may be moved more quickly (faster cord pay out). For heavier weight tools, it may be desired to decrease the rate at which the tool drops should a tool drop occur, and this is easily accomplished by increasing the amount of friction between the components. The adjustment of the friction may not be present in the chosen iteration, or the friction may be set for specific tool weight ranges to avoid accidental misuse.

Although the tool could be moved quickly thereby activating the engaging mechanism and, if used, the braking mechanism, the user could easily overcome the mechanism by continuing to move the tool away from the housing. Therefore, the mechanism does not greatly hinder use of the tool.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. A retractable tool lanyard, comprising:

a housing defining a cavity;

a drum rotatably connected to the housing within the cavity;

a biasing member interconnecting the housing and the drum;

a cord operatively connected to the drum and configured and arranged to be wound about and paid out from the drum, the biasing member urging the cord to be wound about the drum;

an engaging mechanism operatively connected to the drum, the engaging mechanism comprising:

a locking plate connected to the drum;

at least one lock pawl pivotally connected to the locking plate, the at least one lock pawl pivotable from an unlocked position to a locked position, wherein when the drum rotates at a predetermined speed as the cord is paid out from the drum, the at least one lock pawl pivots from the unlocked position to the locked position; and a ratchet plate including a ratchet ring on a first side of the rachet plate and a star ring on a second side of the ratchet plate, the at least one lock pawl configured and arranged to engage the ratchet ring when in the locked position thereby rotating the ratchet plate with the drum; and a braking mechanism including at least one brake pad positioned between the ratchet plate and the housing, the at least one brake pad configured and arranged to create friction on the ratchet plate when the ratchet plate rotates to assist in reducing a rate of rotation of the ratchet plate and thereby the drum; and a clicker pawl being pivotally connected to the housing and configured and arranged to selectively engage the star ring on the second side of the ratchet plate, the clicker pawl providing a braking force and producing audible indication when the at least one lock pawl is in the locked position and the ratchet plate rotates with the drum.

2. The retractable tool lanyard of claim 1, wherein the at least one brake pad includes a first cotton pad, a first steel pad, a second cotton pad, and then a second steel pad.

3. The retractable tool lanyard of claim 1, further comprising an adjuster, comprising:

a fastener extending through the ratchet plate, through the at least one brake pad, and through the housing, a distal end of the fastener extending through the housing; and a knob operatively connected to the distal end of the fastener, wherein the knob is configured and arranged to move along the distal end to adjust an amount of friction between the braking mechanism and the housing.

4. The retractable tool lanyard of claim 3, wherein the knob includes a first indicator and the housing includes at least two indicators associated with different amounts of friction.

5. The retractable tool lanyard of claim 4, wherein the housing includes four indicators associated with different amounts of friction.

6. The retractable tool lanyard of claim 1, further comprising a clicker pawl biasing member interconnecting the clicker pawl and the housing.

7. The retractable tool lanyard of claim 1, further comprising a lock pawl biasing member interconnecting each of the at least one lock pawl and the locking plate.

8. The retractable tool lanyard of claim 1, wherein the housing is configured and arranged to connect to a user and a distal end of the cord is configured and arranged to engage a tool, and wherein the braking mechanism slows a rate at which the tool falls should a tool drop occur thereby reducing an amount of force exerted on the user.

9. A retractable tool lanyard, comprising:

a housing defining a cavity;

a drum rotatably connected to the housing within the cavity;

a biasing member interconnecting the housing and the drum;

a cord operatively connected to the drum and configured and arranged to be wound about and paid out from the drum, the biasing member urging the cord to be wound about the drum;

an engaging mechanism operatively connected to the drum, the engaging mechanism comprising:

a locking plate connected to the drum;

at least one lock pawl pivotally connected to the locking plate, the at least one lock pawl pivotable from an unlocked position to a locked position, wherein when the drum rotates at a predetermined speed as the cord is paid out from the drum, the at least one lock pawl pivots from the unlocked position to the locked position;

a ratchet plate including a ratchet ring on a first side of the ratchet plate, the at least one lock pawl configured and arranged to engage the ratchet ring when in the locked position thereby rotating the ratchet plate with the drum; and a braking mechanism, comprising:

at least one brake pad positioned between the ratchet plate and the housing, the at least one brake pad configured and arranged to create friction on the ratchet plate when the ratchet plate rotates to assist in reducing a rate of rotation of the ratchet plate and thereby the drum; and an adjuster comprising:

a fastener extending through the ratchet plate, through the at least one brake pad, and through the housing, a distal end of the fastener extending through the housing; and a knob operatively connected to the distal end of the fastener, wherein the knob is configured and arranged to move along the distal end to adjust an amount of friction between the braking mechanism and the housing, wherein the knob includes a first indicator and the housing includes at least two indicators associated with different amounts of friction.

10. The retractable tool lanyard of claim 9, the engaging mechanism further comprising a star ring on a second side of the ratchet plate and at least one clicker pawl pivotally connected to the housing and configured and arranged to selectively engage the star ring, the at least one clicker pawl producing audible indication when the at least one lock pawl is in the locked position and the ratchet plate rotates with the drum.

11. The retractable tool lanyard of claim 10, further comprising a clicker pawl biasing member interconnecting each of the at least one clicker pawl and the housing.

12. The retractable tool lanyard of claim 9, wherein the at least one brake pad includes a first cotton pad, a first steel pad, a second cotton pad, and then a second steel pad.

13. The retractable tool lanyard of claim 9, further comprising a lock pawl biasing member interconnecting each of the at least one lock pawl and the locking plate.

14. A retractable tool lanyard, comprising:

a housing defining a cavity;

a drum rotatably connected to the housing within the cavity;

a biasing member interconnecting the housing and the drum;

a cord operatively connected to the drum and configured and arranged to be wound about and paid out from the drum, the biasing member urging the cord to be wound about the drum;

an engaging mechanism operatively connected to the drum, the engaging mechanism comprising:

a locking plate connected to the drum;

at least one lock pawl pivotally connected to the locking plate, the at least one lock pawl pivotable from an unlocked position to a locked position, wherein when the drum rotates at a predetermined speed as the cord is paid out from the drum, the at least one lock pawl pivots from the unlocked position to the locked position;

a ratchet plate including a ratchet ring on a first side of the ratchet plate and a star ring on a second side of the ratchet plate, the at least one lock pawl configured and arranged to engage the ratchet ring when in the locked position thereby rotating the ratchet plate with the drum; and at least one clicker pawl pivotally connected to the housing and configured and arranged to selectively engage the star ring, the at least one clicker pawl providing a braking force and producing audible indication when the at least one lock pawl is in the locked position and the ratchet plate rotates with the drum.

15. The retractable tool lanyard of claim 14, further comprising a braking mechanism comprising:

at least one brake pad positioned between the ratchet plate and the housing, the at least one brake pad configured and arranged to create friction on the ratchet plate when the ratchet plate rotates to assist in reducing a rate of rotation of the ratchet plate and thereby the drum.

16. The retractable tool lanyard of claim 15, wherein the at least one brake pad includes a first cotton pad, a first steel pad, a second cotton pad, and then a second steel pad.

17. The retractable tool lanyard of claim 15, further comprising an adjuster, comprising:

a fastener extending through the ratchet plate, through the at least one brake pad, and through the housing, a distal end of the fastener extending through the housing; and a knob operatively connected to the distal end of the fastener, wherein the knob is configured and arranged to move along the distal end to adjust an amount of friction between the braking mechanism and the housing.

18. The retractable tool lanyard of claim 17, wherein the knob includes a first indicator and the housing includes at least two indicators associated with different amounts of friction.

19. The retractable tool lanyard of claim 14, further comprising a clicker pawl biasing member interconnecting each of the at least one clicker pawl and the housing.

20. The retractable tool lanyard of claim 14, further comprising a lock pawl biasing member interconnecting each of the at least one lock pawl and the locking plate.

* * * * *